US007832720B2

(12) United States Patent
Fujita

(10) Patent No.: US 7,832,720 B2
(45) Date of Patent: Nov. 16, 2010

(54) SHEET FEEDING DEVICE AND IMAGE FORMING APPARATUS

(75) Inventor: Takashi Fujita, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 7 days.

(21) Appl. No.: 11/868,037

(22) Filed: Oct. 5, 2007

(65) Prior Publication Data

US 2008/0088077 A1 Apr. 17, 2008

(30) Foreign Application Priority Data

Oct. 13, 2006 (JP) ..... 2006-280659

(51) Int. Cl.
*B65H 3/14* (2006.01)
*B65H 1/16* (2006.01)

(52) U.S. Cl. ..... 271/97; 271/98; 271/155

(58) Field of Classification Search ..... 271/11, 271/97, 98, 152–155
See application file for complete search history.

(56) References Cited

U.S. PATENT DOCUMENTS

| | | | | |
|---|---|---|---|---|
| 6,186,492 | B1 * | 2/2001 | Dechau et al. | 271/30.1 |
| 6,354,585 | B1 * | 3/2002 | Takahashi | 271/97 |
| 6,609,708 | B2 * | 8/2003 | Moore et al. | 271/98 |
| 2002/0005610 | A1 * | 1/2002 | Moore et al. | 271/11 |
| 2005/0046104 | A1 * | 3/2005 | Suga et al. | 271/112 |
| 2005/0110207 | A1 * | 5/2005 | Moore et al. | 271/152 |
| 2005/0133980 | A1 * | 6/2005 | Koga | 271/97 |
| 2005/0206068 | A1 * | 9/2005 | Sasaki et al. | 271/98 |
| 2006/0012107 | A1 * | 1/2006 | Ueda et al. | 271/98 |
| 2007/0052162 | A1 | 3/2007 | Fujita et al. | 271/228 |
| 2007/0102870 | A1 * | 5/2007 | Moore et al. | 271/152 |
| 2007/0228639 | A1 * | 10/2007 | Matsumoto et al. | 271/97 |
| 2007/0228640 | A1 * | 10/2007 | Ikeda | 271/98 |
| 2007/0284805 | A1 * | 12/2007 | Ikeda | 271/11 |

FOREIGN PATENT DOCUMENTS

| | | |
|---|---|---|
| JP | 7-89625 | 4/1995 |
| JP | 2005-104723 | 4/2005 |

* cited by examiner

*Primary Examiner*—Patrick Mackey
*Assistant Examiner*—Patrick Cicchino
(74) *Attorney, Agent, or Firm*—Fitzpatrick, Cella, Harper & Scinto

(57) ABSTRACT

An upper limit detection sensor detects that a top face position of a sheet stack on a tray reaches an upper limit position which enables feeding of sheets one by one by a sheet feeding portion and a lower limit detection sensor detects that the top face position of the sheet stack on the tray reaches a lower limit position which enable feeding of sheets one by one. When the sheet stack is loosened by blowing air against a side face of the sheet stack on the tray with an air spouting nozzle provided on an air loosening device, if a sheet floated by air from the air loosening device exceeds an upper limit position of a feeding enabled range, the lowering amount of the tray is controlled so that at least a sheet next to the sheet to be fed is not lower than a lower end position of the air spouting port of the air loosening device.

12 Claims, 16 Drawing Sheets

SHEET FEEDING DEVICE AND IMAGE FORMING APPARATUS

BACKGROUND OF THE INVENTION

1. Field of the Invention

The present invention relates to a sheet feeding device and an image forming apparatus and more specifically to a device for loosening a sheet stack with air before each sheet is fed.

2. Description of the Related Art

Conventionally, an image forming apparatus such as a copying machine, electrophotographic printer, ink jet printer, facsimile, a printing machine is equipped with a sheet feeding device for feeding the sheets one by one from a storage portion in which a plurality of the sheets are stored.

As such a sheet feeding device, recently, there has been proposed a sheet feeding device using air suction method of conveying a sheet by sucking the sheet loaded on a tray, this sheet feeding device using air suction force and conveying force of an endless belt. This technology has been described in Japanese Patent Application Laid-Open (JP-A) Nos. 07-89625 and 2005-104723. In the meantime, such a sheet feeding device has been often used in the image forming apparatus having a high productivity and for which a replacement component having a long service life is demanded.

As shown in FIG. 14, such a conventional sheet feeding device has a storage portion 100 having a tray 101 capable of rising/lowering and a suction conveying belt 126 which conveys a topmost sheet S1 of the sheets S stacked on the tray 101 by suction. This suction conveying belt 126 is capable of conveying the topmost sheet S1 of the stacked sheets when it is located at a predetermined height (feeding enabled range). Then, a paper lower limit detection sensor 122 for detecting that the topmost sheet S1 of the stacked sheets reaches the lower limit position of the feeding enabled range and a paper face upper limit detection sensor 123 for detecting that the topmost sheet S1 reaches the upper limit position of the feeding enabled range are provided.

When the sheet is conveyed in the conventional sheet feeding device having such a structure, the sheet S is loaded on the tray 101 which is provided within the storage portion 100 and can be lifted up/down by a driving means (not shown) and then the tray 101 is lifted up/down. Next, the topmost sheet S1 presses a paper face detection lever 121 and this paper detection lever 121 is detected by the paper face lower limit detection sensor 122 (turns ON) so as to stop the tray 101.

Next, air supplied from a fan (not shown) is blown to an end portion of a sheet stack through a loosening duct 151 to float several pieces of the sheets on the top portion of the sheet stack into a loosened state. At this time, the paper face detection lever 121 is pushed up by the topmost sheet S1 floated and then, this paper face detection lever 121 is detected by the paper face upper limit detection sensor 123 (turns ON). When the tray 101 is lowered, detection of the paper face detection lever 121 by the paper face upper limit detection sensor 123 is eliminated (turns OFF) and then the tray 101 is stopped.

By controlling rising and lowering of the tray 101 in this way, the topmost sheet S1 can be maintained between the upper limit position and the lower limit position and when the topmost sheet S1 is located between the upper limit position and the lower limit position, the control device in the main body determines that feeding of the sheets is enabled.

After the top face position of the topmost sheet S1 comes into an appropriate range enabling it to be fed, sheet feeding operation is carried out. When the sheet feeding operation is started, first, the topmost sheet S1 is sucked to the suction conveying belt 126 by the suction fan 125 provided within a sheet feeding portion 12. Next, the suction conveying belt 126 is rotated by a driving means (not shown) so as to feed only the topmost sheet S1 in a direction of an arrow indicated in FIG. 14 and then, the sheet S1 fed in this way is conveyed to a downstream side by conveying roller pair 161.

If the sheet S on the tray 101 decreases due to successive execution of such sheet feeding operation, the position of the paper face drops accompanied thereby, so that detection of the paper face detection lever 121 by the paper face lower limit detection sensor 122 is eliminated (turns OFF). Then, in such a case, the tray 101 is raised to position the top face position of the topmost sheet S1 within a feeding enabled range.

However, the conventional sheet feeding device cannot determine whether or not a second and following sheets are loosened (in a floating condition) because the paper face upper limit detection sensor 123 can detect only the top face position of the topmost sheet.

For example, in an action before feeding a sheet in order to position the topmost sheet S1 in an appropriate range, sometimes, only the topmost sheet S1 is floated by air flown to the sheet front end portion. At this time, the paper face detection lever 121 is rotated by the topmost sheet S1 so that it is detected by the paper face upper limit detection sensor 123 and then the tray 101 is lowered. In this condition, the topmost sheet S1 is tilted such that its rear end side is lowered as shown in FIG. 15 because the second and following sheets are not floated.

However, in this condition, the front end side of the topmost sheet S1 is floated and the paper face upper limit detection sensor 123 detects the paper face detection lever 121 and consequently, the tray 101 continues to be lowered. Thus, the paper face upper limit detection sensor 123 does not detect the paper face detection lever 121 and when the tray 101 is stopped, the topmost sheet S1 is stopped with a large tilting condition.

As a result, the upstream portion in the sheet feeding direction of the topmost sheet S1 becomes far from the suction conveying belt 126 largely, so that sometimes, suction of the sheet by the suction conveying belt 126 cannot be executed. In this case, sheet feeding failure occurs, so that jamming is generated.

Even if the capacity of the suction fan 125 is so high that the topmost sheet S1 can be sucked and conveyed, it takes time to lift up the tray 101 up to the sheet feeding lower limit position in which the paper face lower limit detection sensor 122 detects the sheet because a next sheet droops largely. If it takes time for the tray 101 to be lifted up, feeding of the sheet becomes slow thereby lowering productivity. Further, if the next sheet delays, it is detected that the sheets are not conveyed at an appropriate interval by a sensor or the like, and consequently, the sensor determines that it is jamming by mistake.

Although in the sheet feeding device mentioned in the JP-A No. 07-89625, a position (height) of a sheet on the front end side is measured with a distance measuring sensor and the discharge amount of loosening air is controlled by a fan rotation number so that the topmost sheet is located at an appropriate position, this structure can only detect the position of the topmost sheet. Therefore, loosening condition of the sheets cannot be determined.

On the other hand, in the sheet feeding device of the above described JP-A No. 2005-104723, the sheet is photographed with an image pickup element such as CCD disposed on a sideway of the sheet stack and image processing is carried out to determine a loosening condition of the sheets located under the topmost sheet. However, in this case, the device is complicated and cost is increased.

SUMMARY OF THE INVENTION

Accordingly, the present invention has accomplished in views of such a situation and an object of the invention is to provide a sheet feeding device and image forming apparatus capable of stabilizing loosening condition with an inexpensive structure.

To achieve the above-described object, the present invention provides a sheet feeding device which feeds a sheet, comprising: a tray which supports the sheet and capable of being lifted up/down; a sheet feeding portion which feeds a sheet at a topmost position of the sheet stack supported by the tray; an air loosening device for loosening the sheet stack by blowing air to an end portion of the sheet stack supported by the tray; and a sheet detecting device capable of detecting a position of the sheet at the topmost position in the height direction of the sheet stack supported by the tray, wherein when the tray is lowered based on a detection of the detecting device while the air loosening device blows an air against sheets stacked on the tray, the lowering amount of the tray is controlled so that at least a sheet next to the sheet to be fed presently is not lower than a lower end position of an air spouting port of the air loosening device.

DESCRIPTION OF THE EMBODIMENTS

Hereinafter the preferred embodiments of the present invention will be described in detail with reference to the accompanying drawings.

Figure 1:
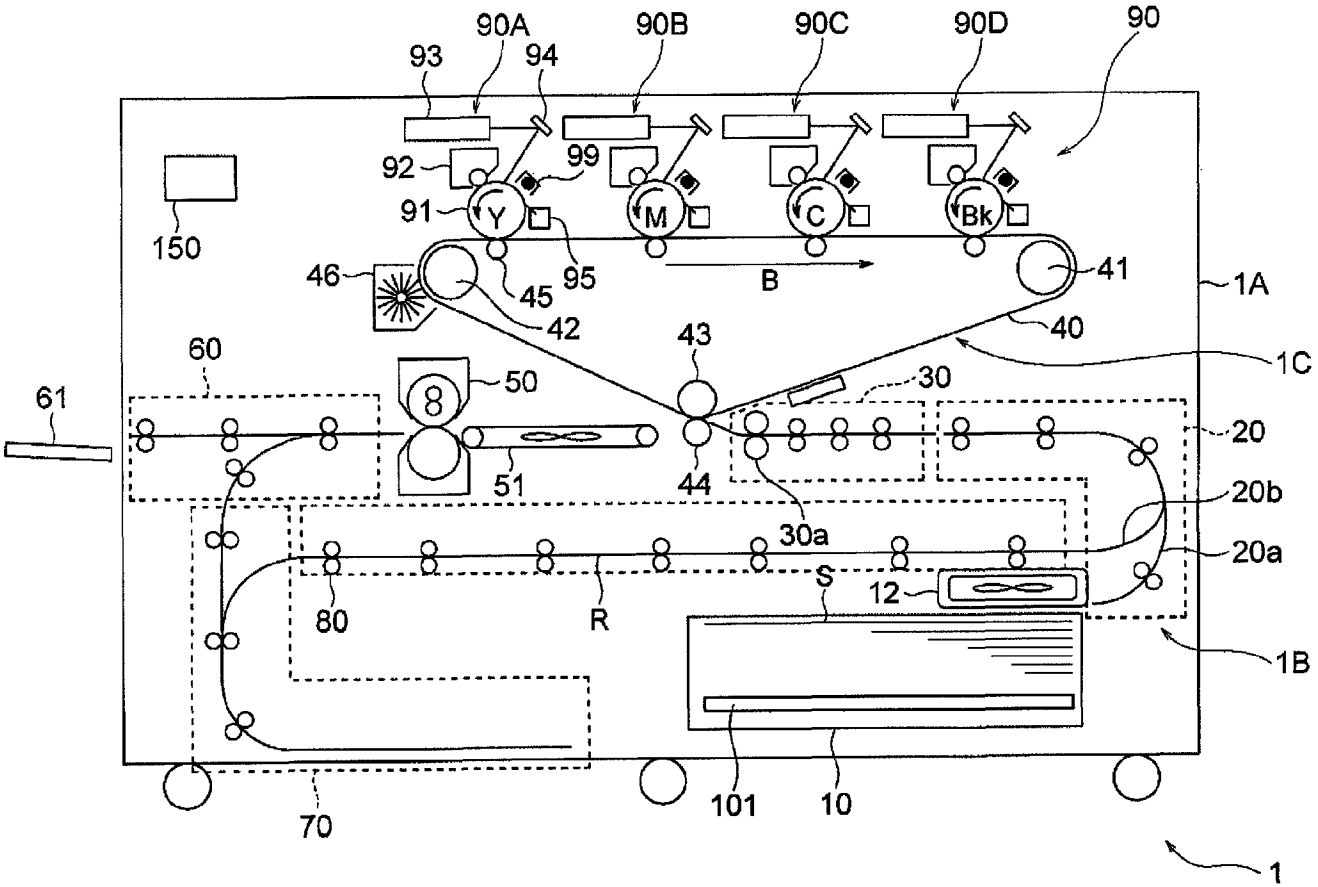
FIG. 1 is a diagram showing a schematic structure of a color image forming apparatus which is an example of the image forming apparatus having the sheet feeding device according to a first embodiment of the present invention.

FIG. 1 is a diagram showing a schematic structure of a color image forming apparatus which is an example of the image forming apparatus equipped with the sheet feeding device according to the first embodiment of the present invention.

In FIG. 1, a color image forming apparatus 1, and a color image forming apparatus main body 1A (hereinafter referred to as apparatus main body) are shown. The apparatus main body 1A includes an image forming portion 90, a sheet feeding device 1B for conveying a sheet S and a transfer portion 1C for transferring a toner image formed by the image forming portion 90 to the sheet S conveyed by the sheet feeding device 1B.

The image forming portion 90 includes image forming units 90A-90D for yellow (Y), magenta (M), cyan (C) and black (Bk). Each of these image forming units 90A-90D includes a photosensitive drum 91, development device 92, exposure device 93, primary transfer roller 45, charging device 99, photosensitive body cleaner 95 and the like. In the meantime, colors formed by the respective image forming units 90A-90D are not limited to four colors and the arrangement order of the colors is limited to this example neither.

The sheet feeding device 1B includes a storage portion 10 provided such that it can be drawn in a forward direction in the Figure through a slide rail (not shown) with respect to the apparatus main body 1A and a sheet feeding portion 12 for feeding the sheet S accommodated in the storage portion 10 by sucking with air.

The transfer portion 1C is stretched by a drive roller 42, a tension roller 41, a secondary transfer inner roller 43 and the like and includes an intermediate transfer belt 40 which is driven in a direction of an arrow B in the Figure.

A toner image formed on the photosensitive drum is transferred to this intermediate transfer belt 40 by a predetermined pressure applied by the primary transfer roller 45 and electrostatic load bias. Then, a not fixed image is attracted to the sheet S by providing with a predetermined pressure and electrostatic load bias in a secondary transfer portion constituted of the secondary transfer inner roller 43 and a secondary transfer outer roller 44 substantially opposing each other.

A control device 150 which is shown in FIG. 1 controls an image forming operation of the color image forming apparatus 1, sheet feeding activity and the like.

When an image is formed in the color image forming apparatus having such a structure, first, the surface of the photosensitive drum 91 is charged equally by the charging device 99. After that, the exposure device 93 emits light based on a transmitted image information signal to the photosensitive drum 91 rotated in the direction of an arrow and a latent image is formed on the surface of the photosensitive drum by irradiating this light appropriately through a reflecting means 94. In the meantime, a small amount of transfer toner remaining on the photosensitive drum 91 is collected by the photosensitive member cleaner 95 and stored for next image formation.

Next, toner development is carried out to an electrostatic latent image formed on the photosensitive drum 91 by the development device 92 so as to form a toner image on the photosensitive drum. After that, a predetermined pressure and electrostatic load bias are applied by the primary transfer roller 45 so as to transfer the toner image on the photosensitive drum onto the intermediate transfer belt 40.

Formation of images by the respective image forming units 90A-90D for Y, M, C and Bk in the image forming portion 90 is carried out at a timing of overlapping this image on a toner image in the upstream transferred primarily onto the intermediate transfer belt. As a result, a full-color toner image is formed onto the intermediate transfer belt 40.

The sheet S is fed from the storage portion 10 by the sheet feeding portion 12 at a timing of image forming of the image forming portion 90 and after that, the sheet S is conveyed to a resist unit 30 through a conveyance path 20*a* possessed by a sheet conveyance device 20.

After skew feeding and timing are corrected by this resist unit 30 and the resist roller 30*a*, the sheet S is conveyed to the secondary transfer portion constituted of the secondary transfer inner roller 43 and the secondary transfer outer roller 44 substantially opposing each other. After that, the predetermined pressure and electrostatic load bias are applied in the secondary transfer portion so as to transfer a full-color toner image onto the sheet S secondarily.

The sheet S to which the toner image is transferred secondarily is conveyed to a fixing device 50 by a before-fixing conveying portion 51. Then, a predetermined pressure is applied by a roller and belt substantially opposing each other in the fixing device 50 and heating effect by a heat source such as a heater is applied to the sheet S, so that the toner is melted and fixed on the sheet S.

Next, the sheet S having the fixed image obtained in this way is discharged onto a discharge tray 61 by a branching conveyance device 60. If images are formed on both faces of the sheet S, the sheet S is conveyed to an inversion conveyance device 70 by the branching conveyance device 60 by switching of a switching member (not shown).

When the sheet S is conveyed to the inversion conveyance device 70, the front and rear ends of the sheet S are changed over by switching back of the sheet S and conveyed to a re-conveyance path R provided on a duplex conveyance device 80. After that, the sheet is fed from the re-feeding path 20*b* possessed by the sheet conveyance device 20 by matching with a timing of the a sheet of a following job conveyed from the sheet conveyance device 1B and sent to the secondary transfer portion in the same way. The image forming process is the same as on a first face and thus description thereof is omitted.

Figure 2:
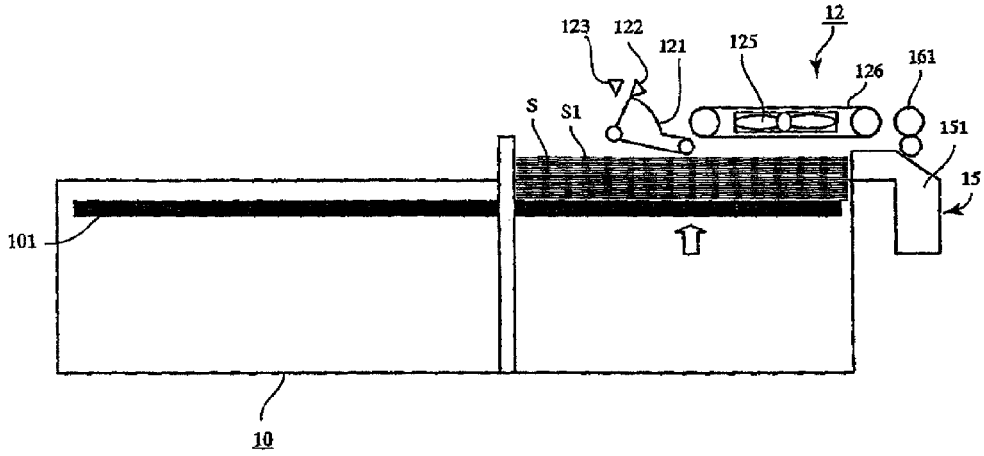
FIG. 2 is a diagram for describing the structure of the sheet feeding device.

As shown in FIG. 2, the sheet feeding device 1B includes the storage portion 10 having the tray 101 on which the sheets are stacked, the sheet feeding portion 12 and the loosening duct portion 15 which is an air loosening device for loosening the top portion of the sheet stack by blowing air to the front end side of the sheet stack on the tray 101. Further, a sheet detecting device for detecting a position in the height direction of the topmost sheet of the sheet stack loaded on the tray 101 is provided.

The sheet detecting device has the paper face lower limit detection sensor 122 which is a lower limit detection sensor for detecting that the top face position (height) of the topmost sheet S1 on the tray 101 reaches the lower limit position of the feeding enabled range which allows the sheet feeding portion 12 to feed the sheets one by one. Further, the sheet detecting device is also provided with the paper face upper limit detection sensor 123 which is an upper limit detection sensor for detecting that the top face position (height) of the topmost sheet reaches the upper limit position of the feeding enabled range which allows the sheet feeding portion 12 to feed the sheets one by one.

These two sensors 122, 123 are photo interrupters and ends thereof are in contact with the topmost sheet S1 while the other ends are located on concentric circles of a rotation center of the paper face detection lever 121 which turns ON/OFF the sensors 122, 123. Consequently, when the paper face detection lever 121 is pressed by the topmost sheet S1 and rotated, the two sensors 122, 123 are turned ON/OFF in accordance with the rotation angle.

Figure 7:
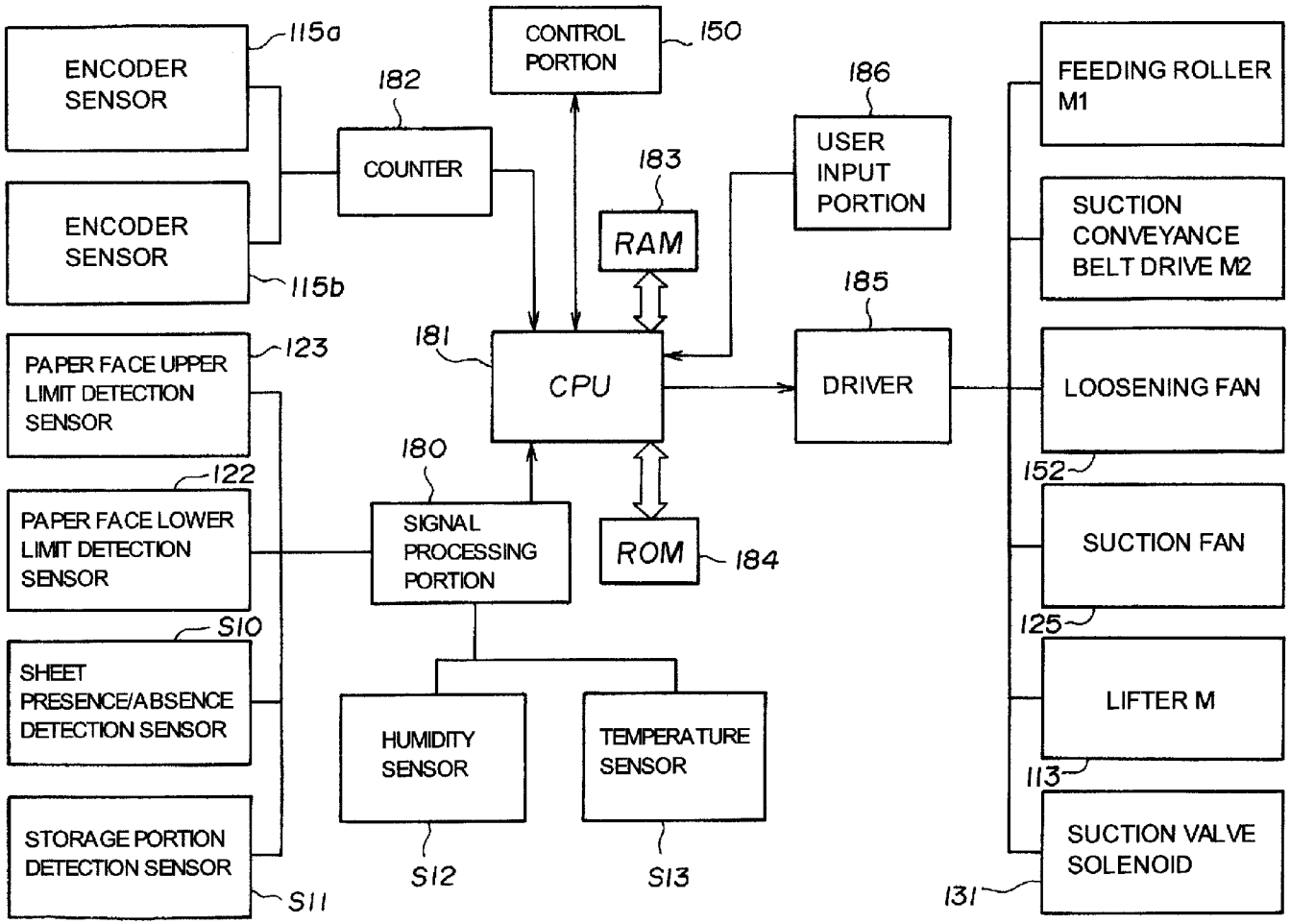
FIG. 7 is a control block diagram of a color image forming apparatus.

ON/OFF of the sensors 122, 123 is inputted to a CPU 181 which is a control device provided on the sheet feeding device 1B through the signal processing portion 180 as shown in FIG. 7 described later. The CPU 181 determines a position (height) of the sheet S1 according to ON/OFF signal from the sensors 122, 123 for detecting that the top face position of the sheet stack on the tray 101 is located within the feeding enabled range which allows the sheet feeding portion 12 to feed the sheets one by one.

Figure 3:
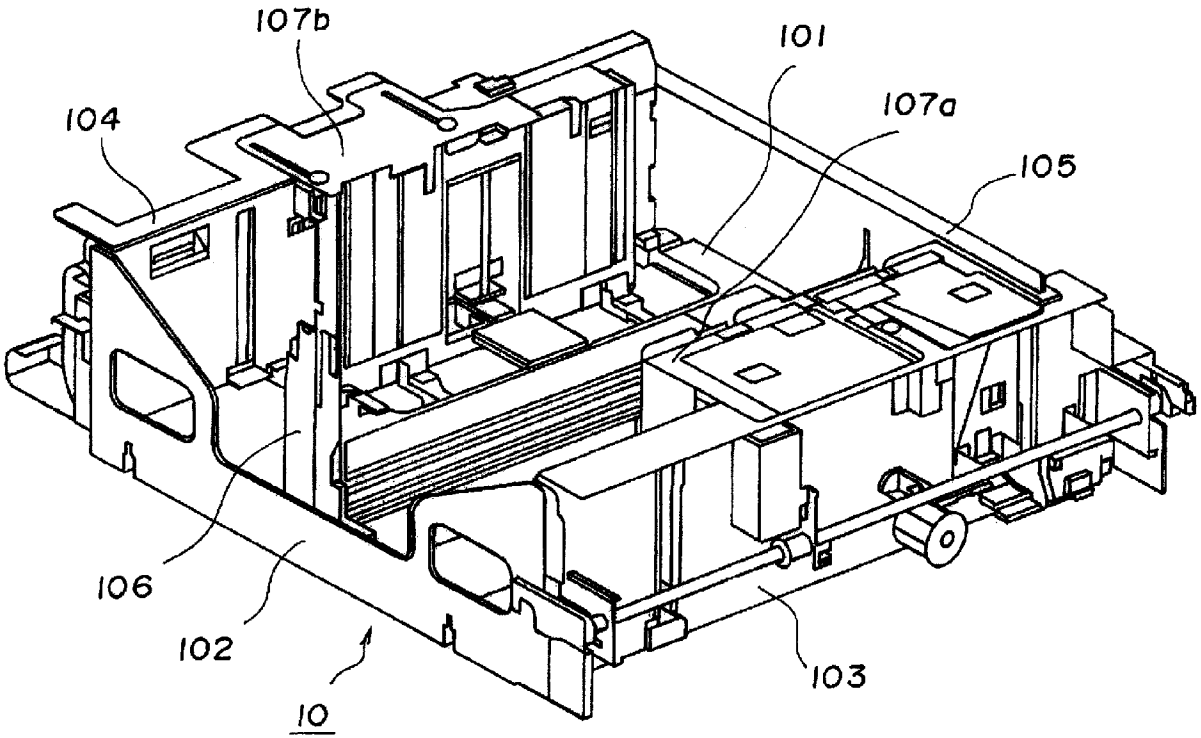
FIG. 3 is a perspective view for describing the structure of a storage portion which constitutes the sheet feeding device.

As shown in FIG. 3, the storage portion 10 has a box-like frame 102, and a tray 101 which is disposed within the frame 102 to support the sheet stack. Further it has side restricting plates 107*a*, 107*b* provided to be movable in a width direction perpendicular to the sheet feeding direction with respect to the frame 102 and a rear end restricting plate 106 provided to be movable in the sheet feeding direction. It is further provided with a front side plate 103 provided on the front side of the apparatus main body 1A of the frame 102, a rear side plate 104 provided on the rear side of the apparatus main body and a sheet front end restricting plate 105 fixed to an end portion in the upstream of the sheet feeding direction.

When the sheet stack is set on the tray 101, with the front end side of the sheets butting against the sheet front end restricting plate 105, the rear end restricting plate 106 is moved in accordance with the sheet size so that it butts against the rear end side of the sheets, thereby preventing a deviation of the placed sheets S. Likewise, side restricting plates 107*a*, 107*b* are interlocked by a mechanism (not shown) as restricting member in the lateral direction so as to restrict the position of the sheets in the width direction with respect to the center thereof.

Further, the tray 101 equipped in the storage portion 10 is constructed to be capable of being raised or lowered by a lifting mechanism 11.

Figure 4:
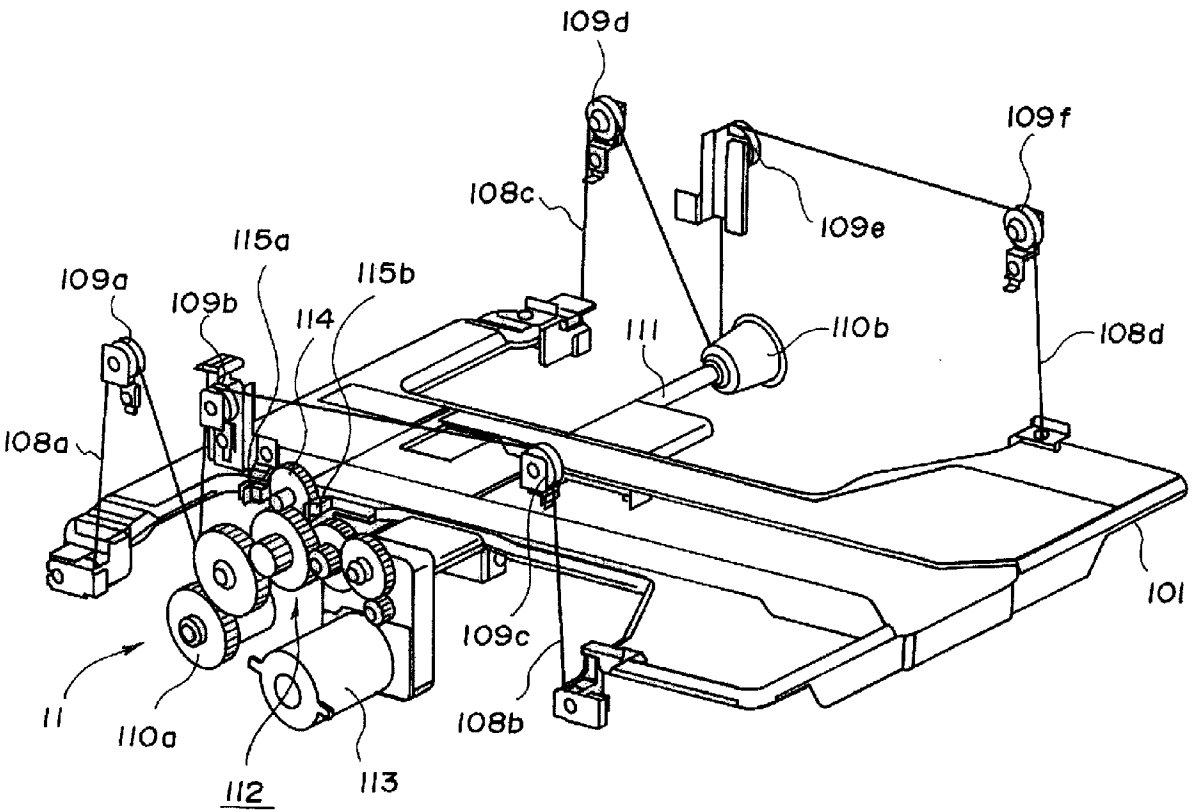
FIG. 4 is a perspective view for describing a lift mechanism for lifting up/down a tray provided in the storage portion.

Wires 108*a*-108*d* whose ends are fixed to four corners of the tray 101 are shown in FIG. 4. These wires 108*a*-108*d* are connected to drive pulleys 110*a*, 110*b* through idler pulleys 109*a*-109*f*.

The drive pulleys 110*a*, 110*b* are connected to a shaft 111 and driven by a lifter motor 113 which is a DC motor capable of rotating in normal and reverse directions through an idler gear 112. The four corners are moved vertically at an equal amount in accordance with the amount of rotation of the drive pulleys 110*a*, 110*b* by driving the drive pulleys 110*a*, 110*b* with the same driving source, so that the tray 101 can be lifted up and down in parallel.

An encoder plate 114 having slits on its outer periphery is provided halfway of an idler gear string 112. Then, a rotation of the encoder plate 114 is counted by encoder sensors 115*a*, 115*b* which are photo interrupters which turns ON/OFF accompanied by a rotation of the encoder plate 114.

ON/OFF signal from the encoder sensors 115*a*, 115*b* which are counting sections is inputted to a counter 182 as shown in FIG. 7. In the CPU 181, ON/OFF signal of the encoder sensors 115*a*, 115*b* is counted by the counter 182 so as to detect the amount of rotation of the lifter motor 113. Then, the amount of lifting of the tray 101 can be calculated based on the amount of rotation of the lifter motor 113.

Figure 5:
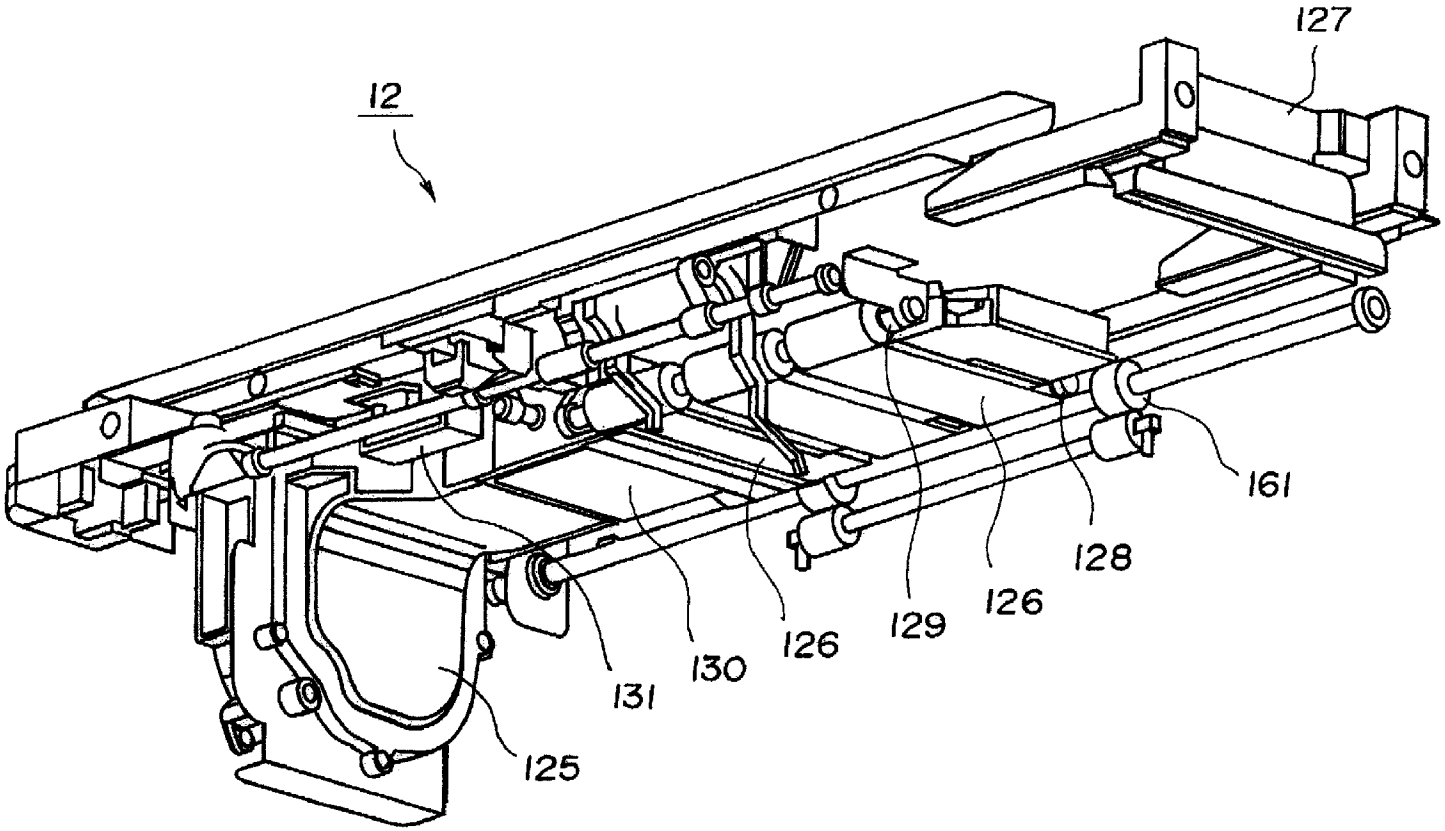
FIG. 5 is a perspective view for describing the structure of a sheet feeding portion which constitutes the sheet feeding device.

As shown in FIG. 5, the sheet feeding portion 12 has a plurality of, for example, three suction conveying belts 126 disposed at an equal interval in the width direction. In the meantime, this suction conveying belt 126 is provided rotatably on the frame 127 and stretched between a drive pulley 128 and an idler pulley 129, driven by a suction conveying belt drive motor M2 (see FIG. 7). Because each drive pulley 128 is fixed to an identical drive shaft, the three suction conveying belts 126 are rotated at the same time.

The suction conveying belt 126 is made of rubber and has a plurality of holes. Due to the provision of the plurality of the holes, air flow generated by a negative pressure from the suction duct 130 equipped with the suction fan (sirocco fan) 125, which generates the negative pressure, passes through the suction conveying belt 126. Thus, by driving the suction fan 125 to keep the interior of the suction duct 130 in a negative pressure when the sheet is conveyed, the topmost sheet S1 in the storage portion 10 can be sucked against the surface of the suction conveying belt 126.

When a sheet is conveyed, suction therefore needs to be turned ON/OFF for each sheet. However, the ON/OFF control of the suction fan 125 produces a loss in rise-up and fall, which cannot meet a high productivity. Thus, according to this embodiment, with the suction fan 125 always turned ON, a suction valve (not shown), provided within the suction duct 130, is opened/closed by a suction valve solenoid 131 so as to control ON/OFF of the suction force.

The sheet feeding portion 12 includes a sheet presence/absence detection sensor S10 for detecting presence/absence of a stacked sheet for controlling the apparatus main body 1A as shown in FIG. 7. In the meantime, a conveyance roller pair 161 is driven by a conveyance roller motor M1 (see FIG. 7).

Next, sheet feeding operation of the sheet feeding portion 12 having such a structure will be described.

When a feeding signal comes, the CPU 181 releases the suction valve by an action of the suction valve solenoid 131 with the suction conveying belt 126 stopped so as to suck the topmost sheet S1 onto the suction conveying belt 126. Next, the suction conveying belt driving motor M2 is driven to rotate the suction conveying belt 126, so that the sucked sheet S1 is fed to the conveyance roller pair 161. Then, the sheet S1 sucked against the suction conveying belt 126 is conveyed to a downstream side by the conveyance roller pair 161 which is driven by the conveyance roller motor M1.

If generation of suction force is continued after the rear end of the sheet S1 passes the suction duct 130, a next sheet is sucked and conveyed. Thus, the suction valve is closed just before the rear end of the sheet passes the suction duct 130 so as to prevent generation of suction force.

The suction conveying belt 126 is stopped at a timing in which the rear end of the sheet S1 passes the drive pulley 128 and likewise, the conveyance roller 161 is stopped at a timing in which the rear end of the sheet passes, so as to stand by for a next sheet feeding signal. Then, the same action is repeated if continuous sheet feeding is carried out.

Figure 6:
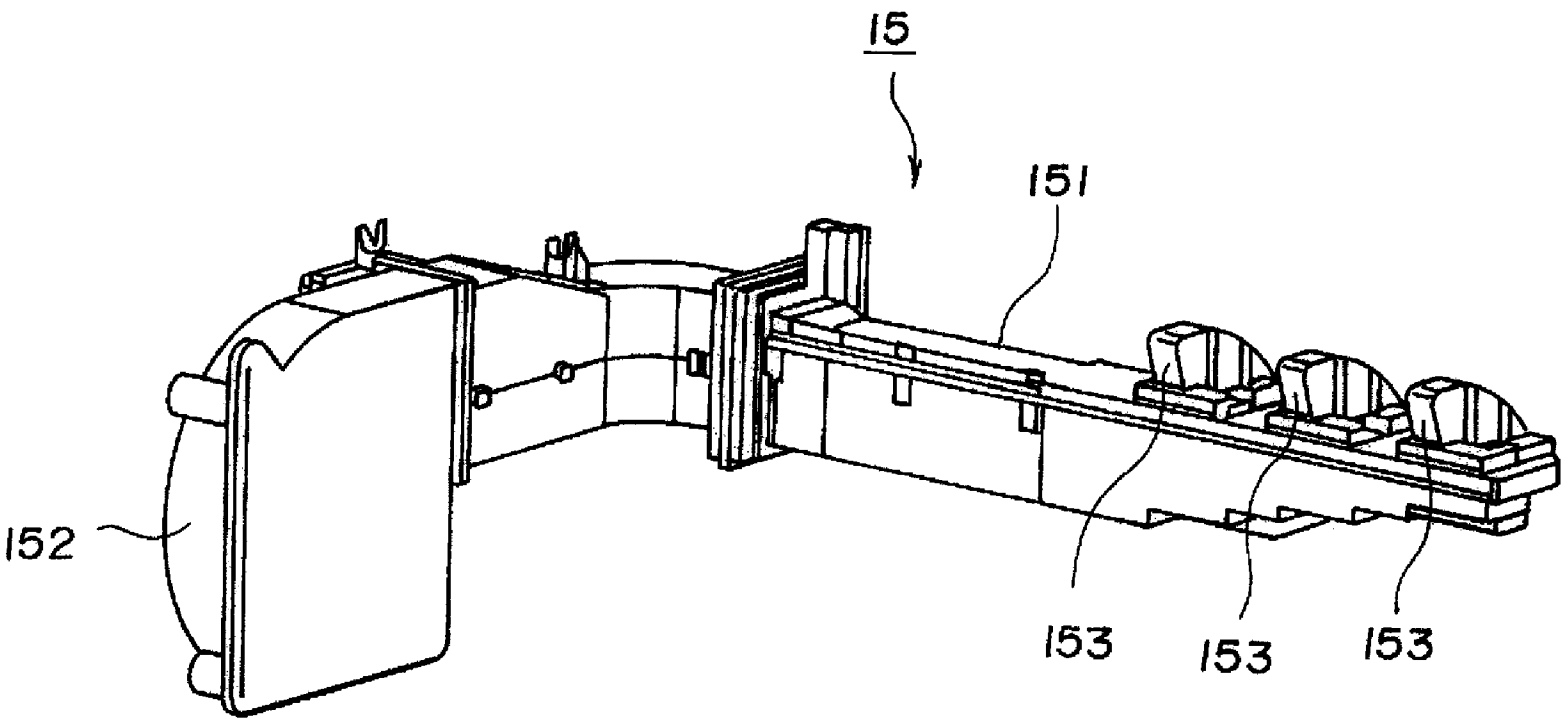
FIG. 6 is a perspective view for describing the structure of a loosening duct portion which constitutes the sheet feeding device.

As shown in FIG. 6, the loosening duct portion 15 has three loosening nozzles 153 which spout air and a loosening fan 152 installed on the rear portion of its main body. Then, air supplied by the loosening fan 152 is spouted from the three loosening nozzles 153 through the loosening duct 151 and blown to the front end side of the sheet stack, to loosen several pieces on the top of the sheet stack.

FIG. 7 is a control block diagram of the color image forming apparatus 1. As shown in FIG. 7, the paper face lower limit detection sensor 122, the paper face upper limit detection sensor 123, the encoder sensors 115*a*, 115*b* and the sheet presence/absence detection sensor S10 are connected to the CPU 181 as shown in FIG. 7. Further, a storage portion detection sensor S11 for detecting that the storage portion 10 is mounted on the apparatus main body 1A and a driver 185 for driving a ROM 184, a RAM 183, a conveyance roller motor M1 and the like are connected to the driver 185.

A temperature sensor S13 provided within the apparatus main body, a humidity sensor S12 and a user input portion 186 for input of information such as sheet thickness, stiffness, weight and the like are connected in order to detect the amount of water in the air.

Figure 8:
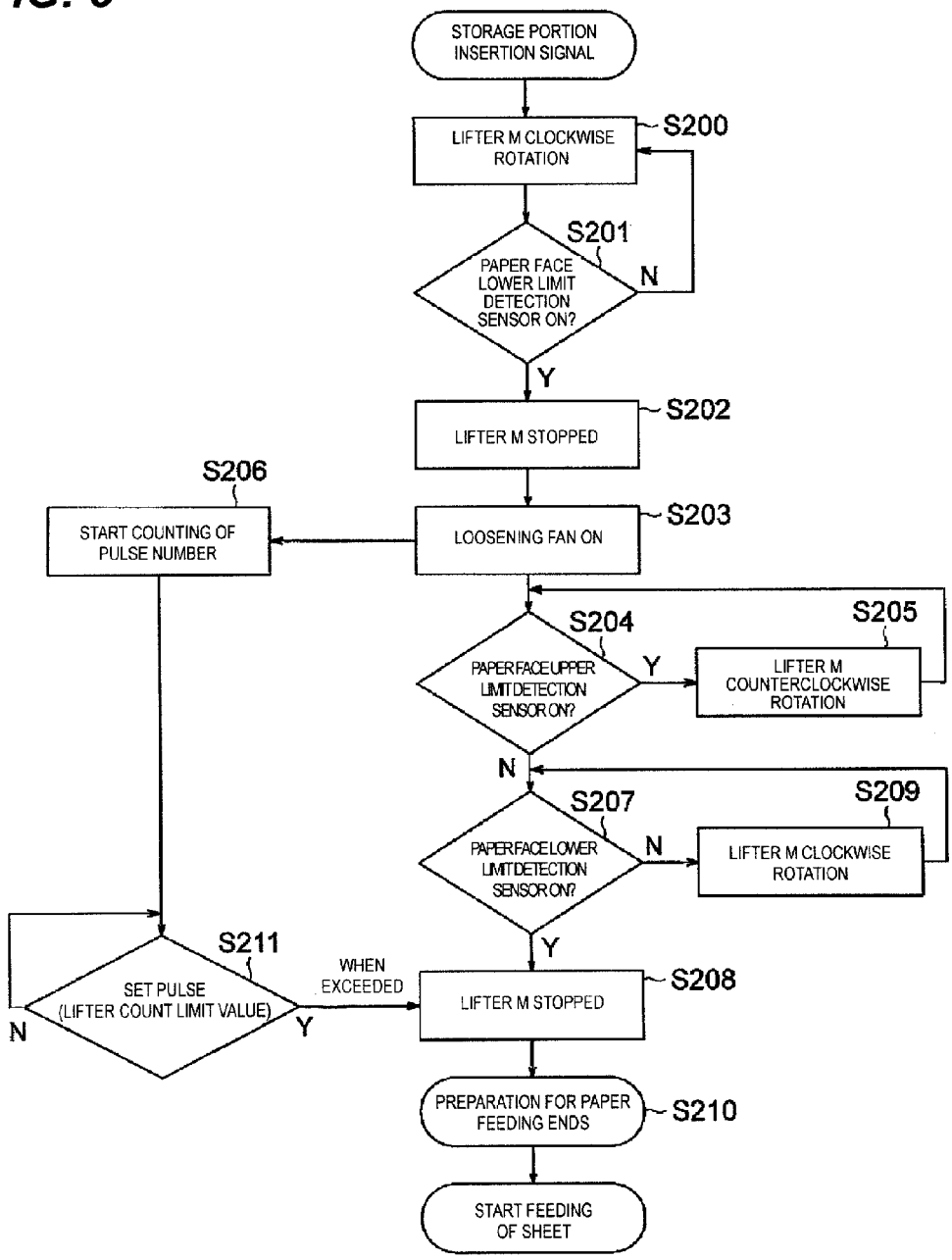
FIG. 8 is a flow chart for describing control of sheet feeding operation of CPU provided on the color image forming apparatus.

Next, control operation of the sheet feeding operation of the CPU 181 will be described using a flow chart shown in FIG. 8.

When user sets sheets in the storage portion 10 and loads the storage portion 10 on the apparatus main body 1A, the storage portion detection sensor S11 detects this, so that the CPU 181 starts sheet feeding preparation sequence according to a signal from the storage portion detection sensor S11.

Consequently, the lifter motor 113 is rotated (driven) in clockwise direction (S200) to lift up the tray 101. Then, the paper face detection lever 121 comes into contact with the topmost sheet S1 stacked in the tray 101 so that the lever is pressed and rotated upward.

Next, when the paper face detection sensor 121 is detected by the paper face lower limit detection sensor 122 as shown in FIG. 2 so that the paper face lower limit detection sensor 122 is turned ON (Y in S201), the lifter motor 113 is stopped (S202). Consequently, the tray 101 is stopped at a position in which the top face of the loaded sheet stack is located at the lower limit position within the feeding enabled range which allows the sheet feeding portion 12 to feed the sheets one by one.

Next, the loosening fan 152 is turned ON (S203) to blow air to the top portion of the sheet stack through the loosening duct 151. When the loosening fan 152 is turned ON, the topmost sheet S1 is floated and accompanied by this, the paper face detection lever 121 is raised further.

Figure 9A:
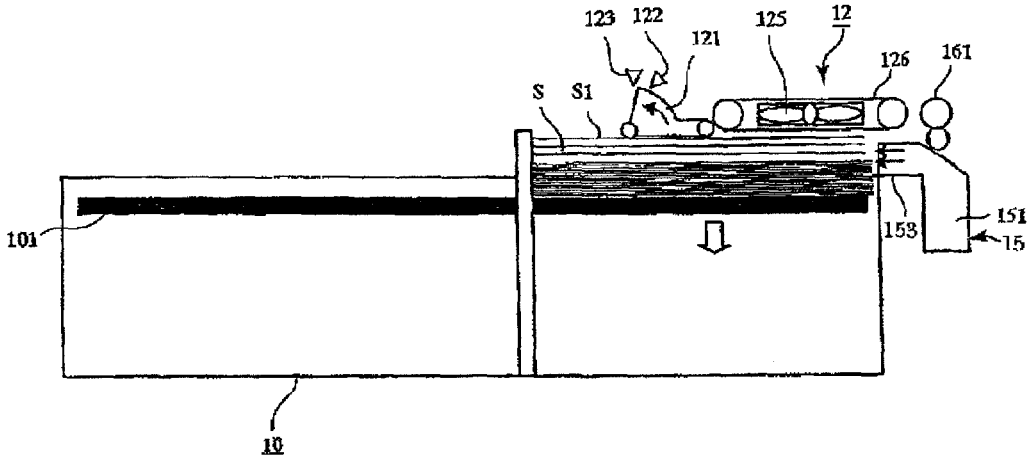
FIGS. 9A and 9B are diagrams for describing the status of the sheet feeding operation of the sheet feeding device.
Figure 9B:
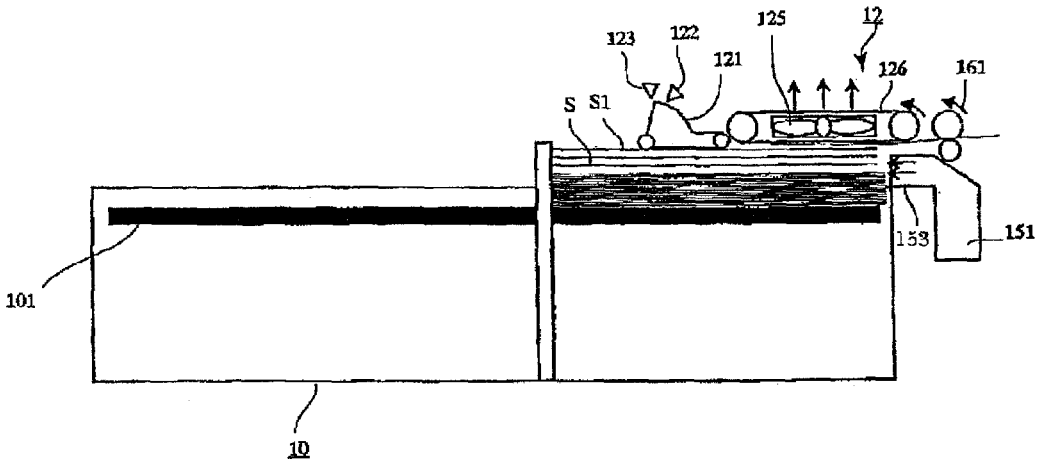

When the paper face upper limit detection sensor 123 detects the paper face detection lever 121 after this, the paper face upper limit detection sensor 123 is turned ON. When the paper face upper limit detection sensor 123 is turned ON (Y in S204), the lifter motor 113 is driven in counterclockwise direction (S205) so as to lower the tray 101 as shown in FIG. 9(*a*).

When the loosening fan 152 is turned ON, counting of pulse number by the encoder sensors 115*a*, 115*b* disposed in the idler gear string 112 is started (S206). Count of the pulse number by the encoder sensors 115*a*, 115*b* is inputted to the CPU 181 as shown in FIG. 7 and the CPU 181 calculates the amount of lift-down of the tray 101 based on this counted number.

According to this embodiment, the encoder sensors 115*a*, 115*b* are disposed by shifting their phases only by half of each slit width in the circumferential direction so that a rotation angle can be counted with a resolution of half the slit width. In this case, as a value which expresses the amount of travel of the tray 101, a count is set to 0.1 mm.

If the paper face upper limit detection sensor 123 is not turned ON (N in S204), while the paper face lower limit detection sensor 122 is ON (Y in S207), the lifter motor 113 is kept stopped (S208) and the preparation for sheet feeding is terminated (S210). After the preparation for sheet feeding is terminated, feeding of the sheets is started.

On the other hand, when the paper face upper limit detection sensor 123 is turned ON (Y in S204) and then the tray 101 is lifted down, the position of the topmost sheet S1 is lowered accompanied by the lowering of this tray 101. When the paper face upper limit detection sensor 123 is turned OFF, the lifter motor 113 is stopped (S208) because the paper face lower limit detection sensor 122 is ON (Y in S207), and then, the preparation for feeding of the sheets is terminated (S210).

After the preparation for feeding of the sheets is terminated, that is, after the top face position of the sheet stack is located within the feeding enabled range which allows the sheet feeding portion 12 to feed the sheets one by one, the feeding of the sheets is started.

Figure 10:
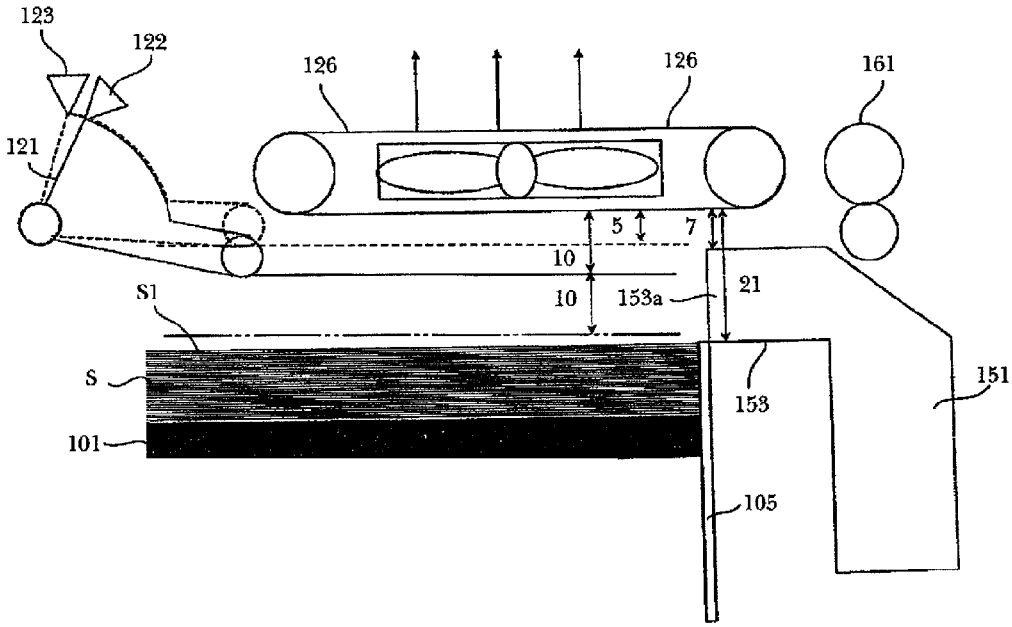
FIG. 10 is a diagram for describing a sheet feeding enabled position of the tray.

In the meantime, this feeding enabled range differs depending on airflow amount of the suction fan 125 and the loosening fan 152, a position of the loosening nozzle 153 and the amount of opening of a spouting port 153*a*. In this embodiment, as shown in FIG. 10, the paper face upper limit position and the paper face lower limit position are set to 5 mm (dashed line) and 10 mm (solid line) respectively from the suction conveying belt 126 and the top end and the lower end of the spouting port 153*a* of the loosening nozzle 153 are set to 7 mm and 21 mm respectively.

If the amount of lift-down of the tray 101 is large after the paper face upper limit detection sensor 123 is turned OFF (N in S204), sometimes the paper face lower limit detection sensor 122 is turned OFF (N in S207). In this case, the lifter motor 113 is rotated (driven) in clockwise direction (S209) to lift up the tray 101.

When loosening of the sheets is carried out wit air flow, a loosened state is not always stable but floating condition might be disturbed by for example curl of the sheet. In this case, the position of the topmost sheet S1 is lowered abruptly when the tray 101 is being lowered. Then, if the position of the topmost sheet S1 is lowered in this way, the paper face lower limit detection sensor 122 is turned OFF at a position in which the lower limit position of the feeding enabled range is exceeded, and in this case, the tray 101 is controlled to be lifted up again.

Although when the topmost sheet S1 is lowered due to instability of the loosened condition, the tray 101 is controlled to be lifted up after the paper face lower limit detection sensor 122 is turned OFF, it takes much time for the tray 101 to rise.

Figure 15:
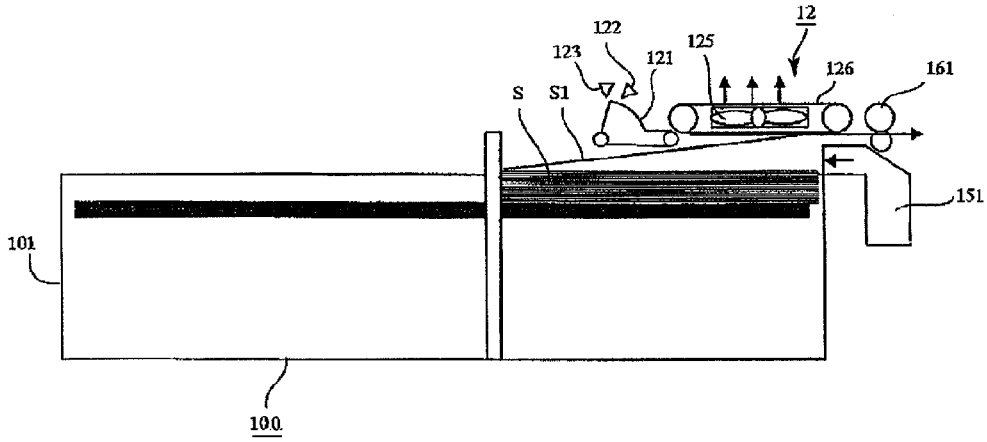
FIG. 15 is a diagram for describing a fault when loosening a sheet stack in the conventional sheet feeding device.

Sometimes the paper face upper limit detection sensor 123 is kept ON depending on the loosened condition of the sheets even if the tray 101 is lowered. In this case, the tray 101 continues to be lowered further. That is, if only the topmost sheet S1 is loosened and floated as shown in FIG. 15 described already, the tray 101 continues to be lowered with the paper face upper limit detection sensor 123 kept ON.

If the tray 101 continues to be lowered with the paper face upper limit detection sensor 123 kept ON so that the paper face lower limit detection sensor 122 is turned OFF and after that, it is attempted to lift up the tray 101, it takes time for the tray 101 to rise. Consequently, a time required for feeding a next sheet is increased thereby possibly reducing productivity (number of sheets fed per unit time) or causing an error in detection of jamming.

Thus, according to this embodiment, when the count value of a lifter lowering amount exceeds a set pulse count (limit value of the lifter count) regardless of the condition of the paper face upper limit detection sensor 123 (Y in S211), lowering of the tray 101 is stopped. That is, a limit value for stopping the lowering of the tray 101 when the pulse count reaches a predetermined value in order to restrict the lowering amount of the tray 101 by counting the lowering amount of the tray 101 according to the pulse count with the encoder sensors 115*a*, 115*b* is set up.

The moving amount of the tray 101 according to the set pulse count is set to lower than a distance in a height direction from a detection position of the topmost position of the sheet stack up to a lower end position of the spouting port 153*a* of the loosening nozzle 153 based on the paper face lower limit detection sensor 122 before blowing of air from the loosening nozzle 153 is started. That is, the lowering amount of the tray 101 is controlled so that a sheet to be fed next to the topmost sheet S1 is not lower than the lower end position of the spouting port 153*a* of the loosening nozzle 153.

This limit value is set for a following reason. If a lowering stop position of the tray 101 based on the limit value is set at a position in which no loosening air strikes the sheets, a second and following sheets cannot be loosened. Then, the limit value of the lowering amount of the tray 101 is set so that the stop position of the tray 101 is above the lower end of the spouting port 153*a* of the loosening nozzle 153 for loosening air to strike the end portion of the second sheet of the sheet stack securely.

In this embodiment, the set pulse count (lifter count limit value) for stopping the tray 101 is so set that the tray 101 is located lower by 10 mm (one-dot and dash line) than the paper face lower limit position. Further, the lowering stop position of this tray 101 is set lower by 20 mm than the suction conveying belt and above the lower end of the spouting port of the loosening nozzle 153. If the lowering stop position of the tray 101 is set in this way, the set pulse count at the time of control is 100 counts.

In this embodiment, when a sheet floated by loosening air exceeds the upper limit position of the feeding enabled range, the tray 101 is lowered at a distance which allows the top face of the sheet stack to be located between the lower limit position of the feeding enabled range and the lower end of the spouting port 153*a*. More specifically, if the tray 101 is lowered by such a distance which brings the lifter lowering amount count value to 100 counts, air can be blown against the second and following sheets from the lower end of the spouting port 153*a* of the loosening nozzle 153. Thus, a next sheet is floated by spouted air during conveyance of the topmost sheet so that the next sheet can be blown up to the feeding enabled range which allows the sheets to be fed without raising the tray 101.

By stopping the tray 101 at such a position, tilting of the sheet can be suppressed and thereby the loosening condition can be stabilized with an inexpensive structure. By stabilizing the loosening condition of the sheet in this way, occurrence of jamming can be prevented so as to eliminate error in feeding of the sheets. Further, time required for lifting up/down the tray 101 at the time of next sheet feeding operation is never increased thereby preventing a drop of productivity.

Further, because in this embodiment, the sheet feeding enabled position is lower than the lower limit position of the feeding enabled range, the feeding enabled range can be expanded and consequently, the frequency of lifting operation of the tray 101 can be reduced.

In this embodiment, although as shown in FIG. 10, the top end of the sheet front end restricting plate 105 of the storage portion 10 is at the same position as the lower end of the spouting port of the loosening nozzle 153, the top end of the sheet front end restricting plate can be above the lower end of the spouting port of the loosening nozzle 153. In this case, the lift counter limit value is set so that the position of the top face of the sheet stack is above the top end of the sheet front end restricting plate 105. As a result, loosening air can be spouted securely against the sheet S1.

Next, a second embodiment of the present invention will be described. Features of the second embodiment will be described here, and description of the other structure is omitted because it is the same as the first embodiment.

Figure 11:
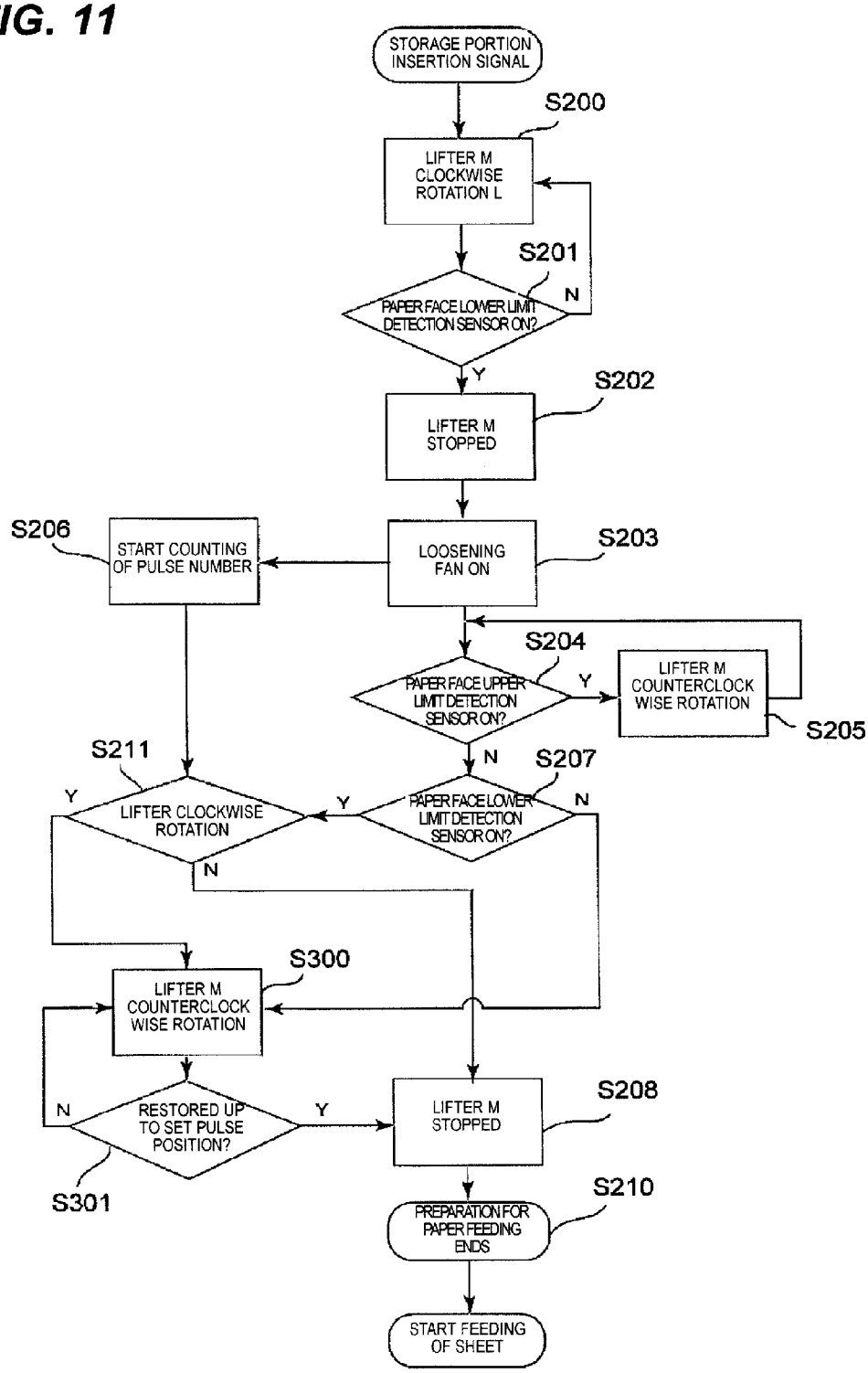
FIG. 11 is a flow chart for describing control of the sheet feeding operation of the CPU provided on the sheet feeding device according to a second embodiment of the present invention.

FIG. 11 is a flow chart showing control operations of the CPU 181 provided on the sheet feeding apparatus of this embodiment. In FIG. 11, the same step numbers as in FIG. 8 indicate the same processing.

Figure 12:
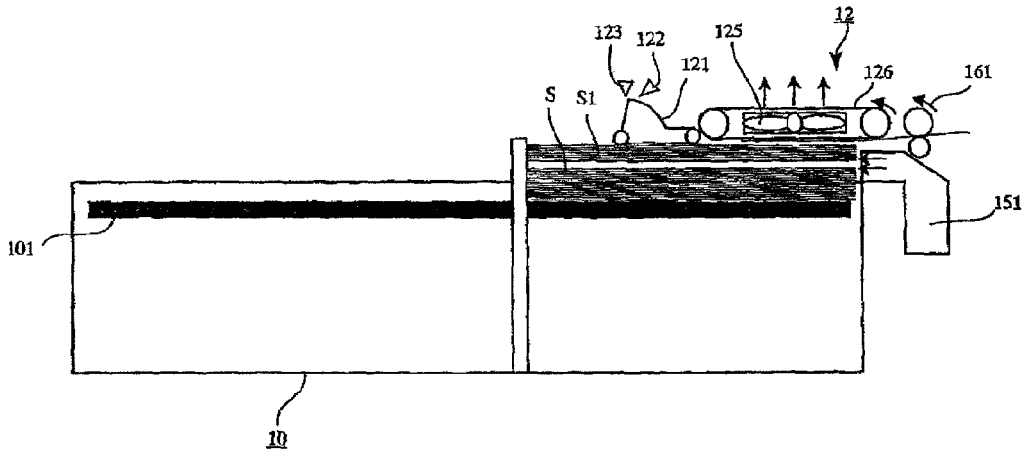
FIG. 12 is a diagram for describing a fault when loosening a sheet stack in the sheet feeding device.

When the sheet is fed, the sheets S might be gathered closely as shown in FIG. 12 due to the type of the sheet (for example, paper thickness, basis weight, density, material), curl condition, temperature/humidity, influence of environment and the like after the loosening action is started. If the feeding of the sheets is started in this condition, the sheets can be fed in a status that several pieces thereof overlap, so called overlapping conveyance.

Then, in this embodiment, as shown in FIG. 11, after the paper face upper limit detection sensor 123 is turned OFF (N in S204), whether or not the paper face lower limit detection sensor 122 is turned ON is determined (S207). Then, when the paper face lower limit detection sensor 122 is ON (Y in S207), whether or not the lifter lowering amount count value exceeds a set pulse (lifter count limit value) is determined (S211) and otherwise (N in S211), the lifter motor 113 is stopped (S208).

If the lifter lowering amount count value exceeds the set pulse (Y in S211), when the paper face lower limit detection sensor 123 is turned ON, the lifter motor 113 is rotated in clockwise direction so as to rise the tray 101 (S300). When the position of the tray 101 is returned to a position (setting pulse position) in which the lifter lowering amount count value turns to a set pulse (Y in S301), the lifter motor 113 is stopped (S208).

In the meantime, when the paper face lower limit sensor 122 is OFF (N in S207), the lifter motor 113 is rotated (driven) in clockwise direction (S300). After this, when the position of the tray 101 is returned to a position in which the lifter lowering amount count value reaches the set pulse (set pulse position) (Y in S301), the lifter motor 113 is stopped (S208).

In this embodiment, if the lowering amount of the tray 101 exceeds a limit value which limits the lowering amount when the paper face upper limit detection sensor 123 continues to be ON, the tray is lowered until the paper face lower limit detection sensor 123 is turned OFF instead of being stopped immediately. After that, the tray 101 is raised up to the sheet feeding enabled position. Then, with such a structure, the vicinity of the topmost sheet is loosened again with loosening air so as to avoid a closely gathered condition, thereby preventing plural sheets from being fed in an overlapping condition.

Although in the description of the embodiment above, an example of controlling the lift-up/down by detecting an encoder pulse on the idler gear string 112 and comparing the lowering amount of the tray 101 with a limit value based thereon has been mentioned, the present invention is not restricted to this. For example, it is permissible to use a stepping motor as a drive motor for lifting up/down the tray 101 so as to count its control pulse and compare the lowering amount of the tray 101 with the limit value based on this drive pulse count to control the lift-up/down.

Further, a position of the tray 101 may be detected directly using a CCD or a distance measuring sensor. By measuring actuation times of the motor and other actuators which are drive sources for lifting up/down the tray 101, the lowering amount of the tray 101 may be compared with the limit value to control the lift-up/down.

As described above, the loosening condition of the sheets differs depending on sheet type and environment. For example, light and thin sheets are more advantageous than thick and heavy sheets for being sucked because the former is easier to float in a close condition. Thus, in case of the light sheets, the lifter count limit value should be set to be relatively large so as to lower a stop position of the tray 101. Because the thick and heavy sheets are likely to tilt the topmost sheet, which is disadvantageous for being sucked, the lifter count limit value should be set to be relatively small so as to raise the stop position of the tray 101.

Thus, user may input sheet information into a user input portion 186 (see FIG. 7) in accordance with the type of the sheet for use and the CPU 181 may change the lifter count limit value based on this input information. That is, the sheet feeding enabled position may be changed in accordance with the type of the sheet. Consequently, a margin to the sheet feeding performance can be expanded.

Because particularly in case where the sheet is paper, its stiffness changes depending on the amount of water content in the air, as the amount of water content increases, a loosening behavior similar to a thin paper is generated even if the same paper type is used. Thus, if paper having large water content is used, the lifter count limit value should be set larger. In the meantime, this water content and the like are used to detect the environment within the storage portion 10 by disposing environmental sensors such as the temperature sensor S13 (see FIG. 7) and a humidity sensor S12 (see FIG. 7).

Figure 13:
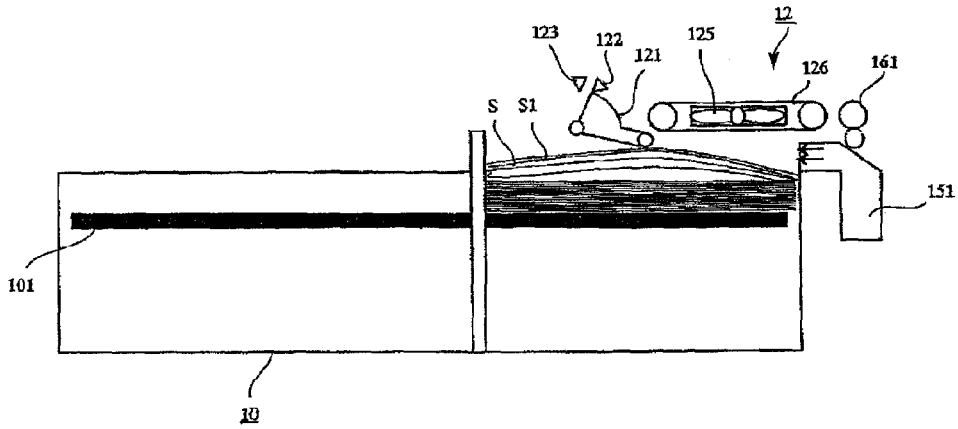
FIG. 13 is a diagram for describing a fault when loosening curled sheets in the sheet feeding device.
Figure 14:
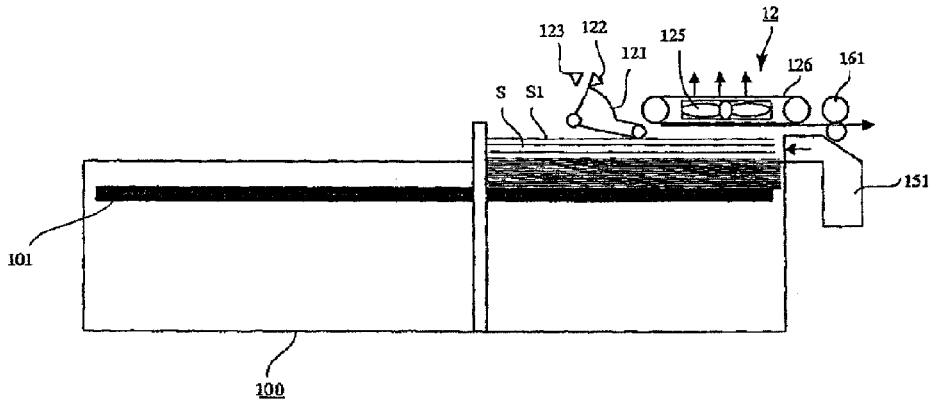
FIG. 14 is a diagram for describing the structure of a conventional sheet feeding device.

Further, curl is easy to generate or curl direction differs depending on the orientation and a difference in density of fibers on the front and rear surfaces, depending on the paper type. Particularly in case of lower curl, as shown in FIG. 13, the front end of a paper is lower than a portion in which the paper face is detected.

In this case, unless the lifter count limit value is set small, the front end of the paper is lower than the loosening nozzle, so that loosening of the sheets is disabled. Thus, if a sheet which is easy to curl is used, the liter count limit value may be determined by comparing the input information of user with paper type data stored in the ROM (see FIG. 7) preliminarily. Further, the lifter count limit value may be determined by combining these values in a matrix chart instead of adopting them independently.

Although in the above description, the sheet feeding device of the present invention has been described about a case where it is applied to an ordinary image forming apparatus, the present invention is not restricted to this example. For example, the present invention may be applied to an image forming apparatus having a sheet processing device which carries out a predetermined processing (for example, boring, bending, surface treatment, binding, and other sheet processings) on sheets supplied one by one. Further, the sheet processing device provided on this image forming apparatus may be provided with the sheet feeding apparatus of the present invention.

This application claims the benefit of priority from the prior Japanese Patent Application No. 2006-280659 filed on Oct. 13, 2006 the entire contents of which are incorporated by reference herein.

What is claimed is:

1. A sheet feeding device which feeds a sheet, comprising:

a tray which supports the sheet and is capable of being lifted and lowered;

a sheet feeding portion which feeds a sheet at a topmost position of a sheet stack supported by the tray;

an air loosening device which loosens the sheet stack by blowing air to an end portion of the sheet stack supported by the tray; and a sheet detecting device capable of detecting a position of the sheet at the topmost position in the height direction of the sheet stack supported by the tray, wherein a maximum lowering amount when the tray is lowered by a control device is set to a value less than a distance in a height direction from the topmost position of the sheet stack by the sheet detecting device before blowing of air by the air loosening device is started to a lower end position of an air spouting port of the air loosening device, and wherein when feeding of the sheet is started, the control device raises the tray until the topmost position of the sheet stack supported by the tray is detected by the sheet detecting device and stops the tray, when the tray, is stopped, floats the sheet by blowing air against the sheet stack from the air loosening device, and when an upper limit detection sensor of the sheet detecting device is turned ON by a sheet floated by air from the air loosening device, lowers the tray while the air loosening device blows air against sheets, and when the upper limit detection sensor is turned OFF by the time when the lowering amount of the tray reaches the maximum lowering amount, stops the tray at a position in which the upper limit detection sensor is turned OFF, and unless the upper limit detection sensor is turned OFF even when the lowering amount of the tray reaches the maximum lowering amount, stops the tray at the position in which the lowering amount of the tray reaches the limit value and starts the feeding action of the sheet by the sheet feeding portion.

2. The sheet feeding device according to claim 1 further comprising:

a driving mechanism for lifting and lowering the tray; and a counter having an encoder plate which is rotated in accordance with the lifting and the lowering of the tray and a counting portion which counts rotations of the encoder plate, and the control device compares a lowering amount of the tray with the maximum lowering amount based on a count value of the counter so as to control the driving mechanism.

3. The sheet feeding device according to claim 1 further comprising:

a stepping motor for lifting and lowering the tray, wherein the control device compares the lowering amount of the tray with the maximum lowering amount based on a drive pulse count of the stepping motor so as to control the stepping motor.

4. The sheet feeding device according to claim 1 further comprising:

a driving source for lifting and lowering the tray, wherein the control device compares the lowering amount of the tray with the maximum lowering amount based on a drive time of the driving source so as to control the driving source.

5. The sheet feeding device according to claim 1 further comprising:

an environment sheet detecting device for detecting an environment condition, wherein the control device changes the maximum lowering amount in accordance with detection of the environment sheet detecting device.

6. The sheet feeding device according to claim 1 further comprising:

an input portion for inputting a type of sheet wherein the control device changes the maximum lowering amount in accordance with input information from the input portion.

7. An image forming apparatus for forming an image on a sheet fed by the sheet feeding device with an image forming portion, comprising:

a tray which supports the sheet and is capable of being lifted and lowered;

a sheet feeding portion which feeds a sheet at a topmost position of a sheet stack supported by the tray;

an air loosening device which loosens the sheet stack by blowing air to an end portion of the sheet stack supported by the tray; and a sheet detecting device capable of detecting a position of the sheet at the topmost position in the height direction of the sheet stack supported by the tray, wherein a maximum lowering amount when the tray is lowered by a control device is set to a value less than a distance in a height direction from the topmost detection position of the sheet stack by the sheet detecting device before blowing of air by the air loosening device is started to a lower end position of an air spouting port of the air loosening device, and wherein when feeding of the sheet is started, the control device raises the tray until the topmost position of the sheet stack supported by the tray is detected by the sheet detecting device and stops the tray, when the tray is stopped, floats the sheet by blowing air against the sheet stack from the air loosening device, and when an upper limit detection sensor of the sheet detecting device is turned ON by a sheet floated by air from the air loosening device, lowers the tray while the air loosening device blows air against sheets, and when the upper limit detection sensor is turned OFF by the time when the lowering amount of the tray reaches the maximum lowering amount, stops the tray at a position in which the upper limit detection sensor is turned OFF, and unless the upper limit detection sensor is turned OFF even when the lowering amount of the tray reaches the maximum lowering amount, stops the tray at the position in which the lowering amount of the tray reaches the limit value and starts the feeding action of the sheet by the sheet feeding portion.

8. The image forming apparatus according to claim 7 further comprising:

a driving mechanism for lifting and lowering the tray; and a counter having an encoder plate which is rotated in accordance with the lifting and the lowering of the tray and a counting portion which counts rotations of the encoder plate, and the control device compares a lowering amount of the tray with the maximum lowering amount based on a count value of the counter so as to control the driving mechanism.

9. The image forming apparatus according to claim 7 further comprising:

a stepping motor for lifting and lowering the tray, wherein the control device compares the lowering amount of the tray with the maximum lowering amount based on a drive pulse count of the stepping motor so as to control the stepping motor.

10. The image forming apparatus according to claim 7 further comprising:

a driving source for lifting and lowering the tray, wherein the control device compares the lowering amount of the tray with the maximum lowering amount based on a drive time of the driving source so as to control the driving source.

11. The image forming apparatus according to claim 7 further comprising:

an environment sheet detecting device for detecting an environment condition, wherein the control device changes the maximum lowering amount in accordance with detection of the environment sheet detecting device.

12. The image forming apparatus according to claim 7 further comprising:

an input portion for inputting a type of sheet, wherein the control device changes the maximum lowering amount in accordance with input information from the input portion.

* * * * *